US005319914A

United States Patent [19]

Premi

[11] Patent Number: 5,319,914

[45] Date of Patent: Jun. 14, 1994

[54] DEVICE FOR THE KNOTLESS JOINING OF THREADS AND YARNS USING COMPRESSED AIR

[75] Inventor: Mauro Premi, Salo', Italy

[73] Assignee: Mesdan S.p.A., Salo, Italy

[21] Appl. No.: 949,143

[22] Filed: Sep. 23, 1992

[30] Foreign Application Priority Data

Sep. 24, 1991 [IT] Italy ..... MI91 A 002537

[51] Int. Cl.[5] ..... D01H 15/00; D01H 13/26

[52] U.S. Cl. ..... 57/22; 57/23; 57/261; 57/350

[58] Field of Search ..... 57/22, 23, 350, 261

[56] References Cited

U.S. PATENT DOCUMENTS

| | | | |
|---|---|---|---|
| 4,424,663 | 1/1984 | Rohner et al. | 57/22 |
| 4,452,035 | 6/1984 | Rohner et al. | 57/22 |
| 4,938,013 | 7/1990 | Zumfeld | 57/350 X |
| 5,105,611 | 4/1992 | Zumfeld et al. | 57/22 |
| 5,152,131 | 10/1992 | Locatelli | 57/350 X |

FOREIGN PATENT DOCUMENTS

| | | | |
|---|---|---|---|
| 3939881 | 6/1991 | Fed. Rep. of Germany | 57/22 |
| 26667 | 2/1991 | Japan | 57/22 |

*Primary Examiner*—Daniel P. Stodola
*Assistant Examiner*—William Stryjewski

[57] ABSTRACT

In a device for the knotless joining of threads and yarns using compressed air, a chamber is provided including central region of substantially U or V cross-section, possibly with a flat base, and two lateral regions of substantially circular cross-section. The slits of the three regions, through which the yarns to be joined are inserted, form a continuous common gap which is closable frontally by a cover. A nozzle opens into the base of the central region in a direction perpendicular to the frontal opening of the slit of said central region, and a nozzle opens into the base of each lateral region opposite the frontal opening of the relative slit in a direction substantially tangential to the circular cross-section, these latter two nozzles being in opposing positions and feedable with compressed air via a duct which is separate from the feed duct for the nozzle opening into the central region.

1 Claim, 1 Drawing Sheet

DEVICE FOR THE KNOTLESS JOINING OF THREADS AND YARNS USING COMPRESSED AIR

BACKGROUND OF THE INVENTION

This invention relates to a device for the knotless joining of threads and yarns using compressed air. These devices, commonly known as "thread splicing devices" are much used for joining threads and yarns, and have largely replaced the previously used knotting devices because of their numerous advantages over these latter.

It has been sought to continuously improve pneumatic splicing devices in order to make them suitable for an increasingly wide range of threads and yarns, including natural fibre, artificial fibre, monofilament, short fibre and long fibre types, to in each case achieve knotless joints of high tensile strength and of good appearance, so that they differ as little as possible from the strength and appearance of the original continuous thread or yarn. Various systems and methods are used to achieve this knotless joining. Pneumatic splicing is always carried out in a splicing chamber (also called a splicing channel) into which, after suitable prior pneumatic or mechanical treatment for removing the original twist of the threads and for opening and parallelizing their fibres, the ends of the threads to be joined together are inserted so that they lie partly superimposed one close to the other and are then subjected to short strong compressed air jets fed into the chamber through variously arranged apertures or nozzles.

One of these systems aims mainly at obtaining thorough mixing of the fibres forming the ends of the threads or yarns to be joined together so that they become effectively tangled and interlaced. To implement this system splicing chambers are used having substantially V or U cross-sections into which the compressed air jet or jets are fed from the base to directly strike the ends of the threads to be joined. As the chamber is in communication with the outside both at its two ends or lateral openings and via the front opening of a longitudinal slit through which the threads are inserted into the chamber, it is well known to close this front opening and hence the chamber during the splicing operation by a cover to prevent the thread ends escaping frontally through the opening of said longitudinal slit by the effect of the compressed air jets which strike them. In this case, under the effect of the jet or jets fed from the base of the chamber, the thread ends undergo violent undulatory action to strike the cover and the chamber base, so that their fibres are effectively interlaced to achieve a good strong knotless joint. However the appearance of the joint obtained suffers from the fact of individual fibres projecting from the sides of the joint.

It has been found that the result is much better if a substantially V or U-shaped chamber is used rather than a circular cross-section chamber, especially if not provided with a cover for the temporary closing of the front opening of its thread insertion slit.

Another system used aims more at mutual rolling-together of the thread ends to be joined, and uses mainly circular cross-section splicing chambers with compressed air feed nozzles arranged to cause rotary air circulation. In this case normally at least two opposing nozzles are used opening substantially tangentially into the circular chamber at points more or less close to the two ends or side openings of the chamber. This system, by which the joints are of excellent appearance because the end fibres of one thread are properly rolled about the other thread but are of less mechanical strength, requires that in arranging the nozzles by which compressed air is fed into the chamber, account be taken of the original twist of the yarns in the sense that they do not cause them to untwist but instead act in the same direction as their twist. The nozzle arrangement has therefore to be changed in changing from S to Z twist yarns to be joined. These briefly described known systems hence each has its advantages and defects.

It was therefore apparent that a system would be sought which combines all the advantageous of those previously used while at the same time eliminating their drawbacks. Attempts in this direction have been made known from the documents DE 32 40 485 A1, DE 34 11 482 A1 and DE 40 19 959 A1.

According to document DE 32 40 485 A1, a splicing device comprises a circular chamber with an oblique slit for inserting the threads to be joined, with two compressed air feed nozzles opening into the centre of the chamber from opposite sides, the first of these nozzles opening into the chamber from one side of said slit and being directed towards the longitudinal axis at the centre of the chamber and against its opposite wall, whereas the other nozzle opens into the chamber from the opposite side of the slit and is directed substantially tangentially to the circular chamber, the first nozzle being connected by a shorter duct and the second nozzle being connected by a longer duct to a common compressed air feed duct. The longitudinal slit through which the threads are inserted into the chamber is again open frontally and in communication with the outside. On feeding compressed air through said feed duct an air jet initially leaves from the first nozzle to interlace the fibres, and a moment later a supplementary air jet leaves from the second nozzle to roll the ends of the threads. The splicing operation takes place in two successive stages with a small delay between the first and second stages due to the different lengths of the ducts by which the compressed air is fed to the two nozzles, air being fed into the chamber firstly only from the first nozzle, and afterwards from both.

According to document DE 34 11 482 A1, the splicing device is improved in the sense that three nozzles are provided for feeding compressed air into the chamber (which is again of circular shape with a frontally oblique longitudinal slit always open for the insertion of the threads), of which one is positioned at the centre of the chamber and is directed towards its longitudinal axis and opposite wall, and the other two nozzles oppose each other and are displaced towards the respective ends of the chamber to open into it substantially tangentially. Compressed air from a single feed duct is fed to the three nozzles via a duct which partly surrounds the circular chamber. In this case the purpose of the central nozzle is to cause fibre interlacing and the purpose of the two opposing lateral nozzles is to roll the ends of the two threads in opposite directions. The arrangement of these lateral nozzles has to be determined on the basis of whether the threads to be joined are of S or Z twist.

Document DE 40 19 959 A1 proposes a further system improvement, consisting substantially of providing to the sides of the slit, through which the threads are inserted into the centre of the chamber, a first two opposing nozzles directed towards the longitudinal axis of the chamber and against its wall opposite said slit, and a further two mutually opposing nozzles displaced towards the respective ends of the chamber and opening into it substantially tangentially. The first two nozzles are connected by a common channel to a first compressed air feed duct and each of the further two nozzles is connected by its own channel to a common second compressed air feed duct. In this manner the order of compressed air feed into the chamber can be diversified so that it occurs firstly only through the first two nozzles and a moment later only through the further two nozzles.

These splicing devices proposed in the three aforesaid documents each have a chamber of circular cross-section constant from one end to the other, the chamber being in communication with the outside not only via its lateral openings but also frontally via the frontal opening of the always open slit through which the threads are inserted and which extends for the entire length of the chamber.

It has now been found that splicing devices of this type still suffer from various drawbacks deriving from the aforedescribed shape of the chamber. Firstly, the fibre interlacing achievable with the nozzle or nozzles directed towards the longitudinal axis of the circular chamber is not perfect in that it is not possible for the air jets leaving these nozzles to transmit the violent beating action and undulating movement to the two threads by which the fibres mutually mix, tangle and interlace. This is because the compressed air can also leave the chamber through the frontal opening of its slit through which the threads are inserted, so losing its effectiveness, and in addition the air jets leaving the nozzles directed towards the longitudinal axis of the chamber must always be directed against a solid opposite wall of the chamber and never against the front opening of said insertion slit, otherwise the threads are expelled from this opening.

In addition, the air jets fed substantially tangentially into the chamber have the same constant uniform cross-section over their entire length, and can therefore interfere with each other to make the rolling of one thread end about the other uncertain.

SUMMARY OF THE INVENTION

The object of the present invention is therefore to further improve splicing devices of the type comprising at least one nozzle for feeding compressed air into the chamber towards its longitudinal axis and two supplementary opposing nozzles displaced towards the respective lateral ends of the chamber and directed substantially tangential to the chamber, in such a manner as to achieve more reliable and resistant fibre interlacing and more perfect rolling of the thread ends to be joined together, to finally produce knotless joints between threads and yarns of any type which are mechanically stronger and have a better appearance. This object is attained according to the invention by a splicing device with a chamber comprising within its length three separate regions of different cross-sections, namely a central region of substantially U or V cross-section and two lateral regions of substantially circular cross-section, these lateral regions of circular cross-section comprising a longitudinal slit of width substantially equal to the width of the slit in the U or V cross-section of the central region, to form a single continuous thread insertion gap extending along the entire length of the chamber, and with a cover for temporarily closing the frontal opening of said gap, wherein into the base of the central region there opens at least one compressed air feed nozzle directed perpendicular to the frontal opening of the slit of said central region, whereas into each of the two lateral regions of circular cross-section there opens a nozzle directed substantially tangential to the relative circular cross-section to create air circulations in opposite directions within the two lateral regions, the nozzle opening into the chamber central region being connected to a first compressed air feed duct and the nozzles opening into the chamber lateral regions being both connected to a second compressed air feed duct.

The term "substantially U or V cross-section" used in the present text is also intended to include U or V cross-sections with a flat base.

By dividing the chamber into three separate regions of different cross-sections and by interposing a central region of substantially U or V cross-section between the two lateral regions of circular cross-section, a central restriction is created within the chamber cross-section. The air jet or jets fed into the chamber central region through the nozzle or nozzles which open into the base of this region are directed towards the frontal opening of the slit in said central region, which during the splicing operation is closed by the cover so that they cannot escape through the frontal opening, with the result that they subject the threads to be joined and present in the chamber a violent undulatory movement so that the threads are beaten alternately against the cover and base of the central region of U or V cross-section, as has been clearly demonstrated by high-speed photography. In this manner a very effective interlacing of the fibres of the two threads in the central part of the joint under formation is obtained, so that they become tangled and interwoven intimately together, to form a joint of high tensile strength. Again, because of the central restriction in the chamber formed by the central region, the circulation or rotary movement in opposite directions induced by the air jets fed into the lateral regions of the chamber are well separated and do not interfere with each other, so that the rolling action of the free ends of the two threads on the respective opposing threads can take place in the proper manner without mutual interference. In this respect, the air fed by the nozzles substantially tangentially into the two lateral regions of the chamber tends to leave it via the respective closest lateral mouth without passing through the central restriction and into the other lateral region of circular cross-section.

The arrangement and orientation of the nozzles opening into the two lateral circular cross-section regions of the chamber must be based on the type of twist, ie S or Z, of the yarns to be joined together, in the sense of acting in the same direction as the yarn twist.

Again, with the splicing device according to the invention the compressed air feed into the various chamber regions takes place in succession at different times, i.e., compressed air is fed firstly into the central region and then simultaneously into the two lateral regions of the chamber.

BRIEF DESCRIPTION OF THE DRAWINGS

One embodiment of a splicing device according to the invention is illustrated schematically in the accompanying drawings, in which.

DETAILED DESCRIPTION

Figure 2:
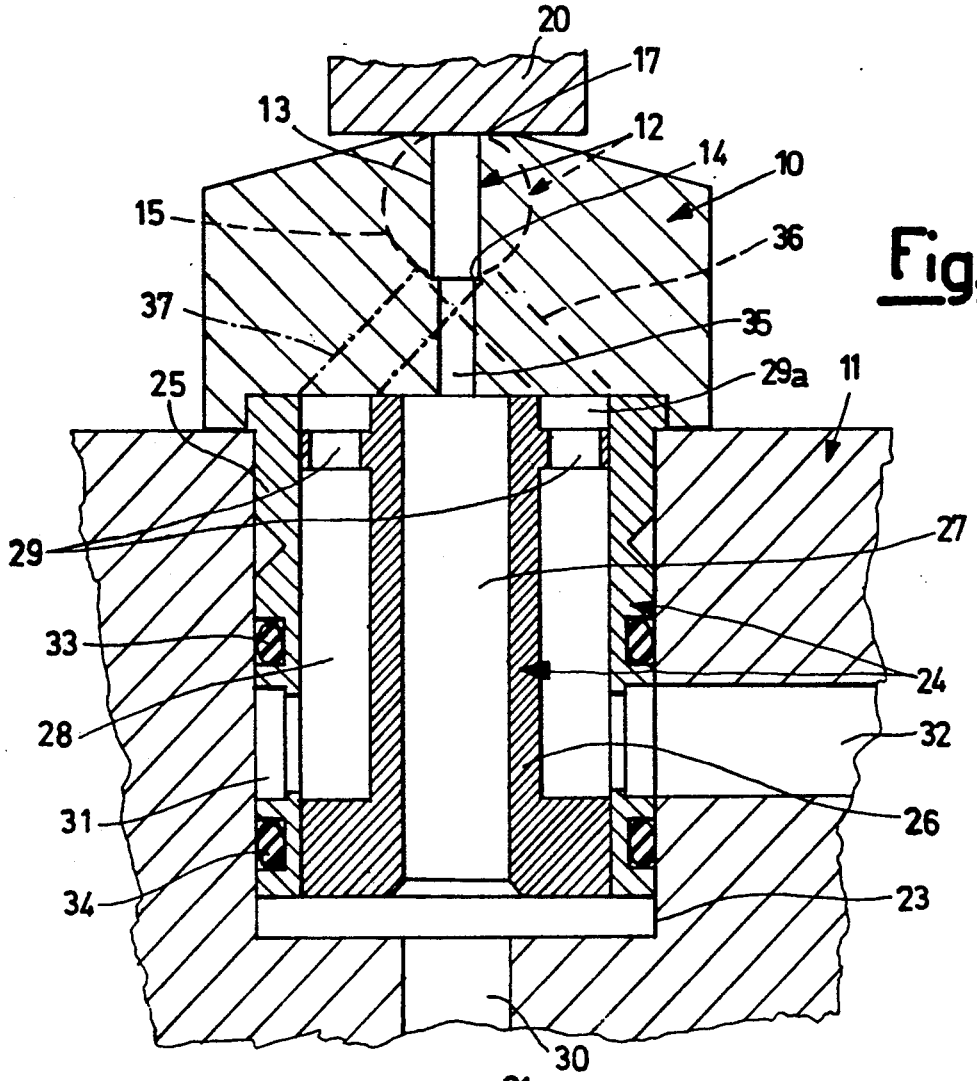
FIG. 2 is a section through the device on the line II-II of FIG. 1.
Figure 1:
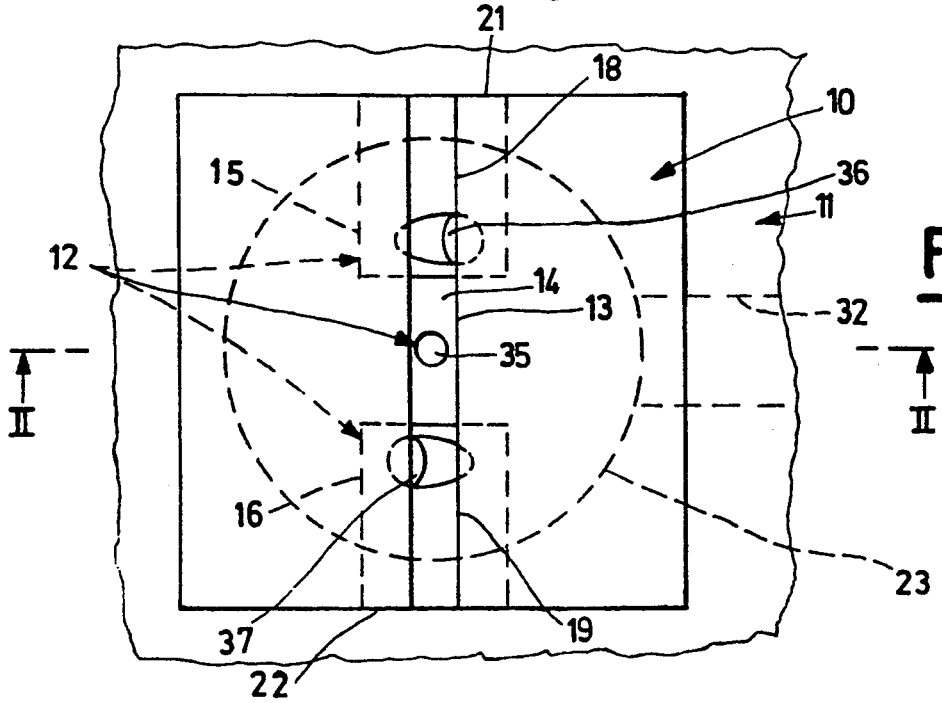
FIG. 1 is a plan view.

As can be seen from these schematic drawings, the device comprises a head 10 fixed or fixable by means not shown onto a block 11. In the head 10 there is provided a chamber, indicated overall by 12, for splicing the yarns, not shown. In its longitudinal extension, the chamber comprises a central region 13 substantially of U cross-section with a flat base 14 in the illustrated embodiment, and two lateral regions 15 and 16 of substantially circular cross-section. The height of the central region 13 corresponds in the illustrated case substantially to the diameter of the lateral regions 15 and 16, however its base 14 could also be located at a lesser depth than the base of the lateral regions. The central region 13 comprises a slit 17, the lateral regions 15 and 16 also comprising slits 18 and 19 respectively, having the same width as the slit 17. The frontal openings of the slits 17, 18 and 19 lie in the same plane, the three slits forming a single longitudinal gap for inserting the threads to be joined into the chamber 12. It should be noted that the plane containing the frontal opening of this insertion gap is slightly raised on the head 10, so that a cover indicated schematically by 20 in FIG. 2 can be rested on this plane to temporarily close the frontal opening of the insertion gap, so that the interior of the chamber 12 remains open to the outside only via the lateral mouths 21, 22 of the lateral regions 15 and 16.

It is apparent that the central region of U cross-section creates a central restriction in the chamber cross-section between the two regions 15 and 16 of circular cross-section.

A circular section cylindrical cavity 23 in the block 11 below the splicing head 10 is provided with a compressed air distribution insert 24 having two elements, namely an annular element 25, and a central element 26 with outer lower and upper flanges and a central cavity 27 and annular peripheral cavity 28. The central cavity 27 connects a first compressed air feed duct 30 provided within the block 11 to a channel 35 provided within the head 10, whereas the peripheral cavity 28 connects a second compressed air feed duct 32 provided within the block 11 to channels 36, 37 provided within the head 10, via an annular channel 31 in the annular element 25, two holes 29 in the upper flange of the element 26 and a further upper annular cavity 29*a*. O-rings 33, 34 provided in seats in the annular element 25 hermetically separate the two compressed air feed circuits.

The channel 35 provided in the head 10 opens in the form of a nozzle into the base 14 of the U cross-section central region 13 of the chamber and is directed perpendicular to the frontal opening of the slit 17 of the central region 13. The upper cavity 29*a* communicates with the channels 36 and 37 provided in the head 10, these channels opening in the form of nozzles in the lateral regions 15 and 16 of the chamber respectively. The channels 36 and 37 oppose each other symmetrically about a central plane through the chamber (see FIG. 2) and open from opposite sides in correspondence with the base, i.e., opposite the frontal openings of the slits 18, 19, into the relative lateral regions 15 and 16, substantially tangentially to the circular cross-section of these regions, so that the rotary air circulation produced by the jet fed through the nozzle 36 into the lateral region 15 of the chamber is right-handed (see FIG. 2), whereas that produced by the jet fed through the nozzle 37 into the lateral region 16 is left-handed. It should be noted that in FIG. 2 the channel 37 is not visible and is therefore indicated for clarity by dashed and dotted lines. This embodiment is suitable for yarns with Z twist, whereas for yarns with S twist the arrangement and orientation of the nozzles 36 and 37 have to be the opposite about the central longitudinal plane through the chamber.

The operation of splicing or joining two threads with the aforedescribed device is as follows:

After being suitably prepared in known manner, the ends of the two threads to be joined are inserted into the chamber 12 from opposite ends through the frontal opening of the common gap of the three regions 13, 15 and 16, so that they are partly superposed on the base of the chamber 12. The cover 20 is then closed and the splicing operation can commence.

In a first stage of the operation, compressed air is fed through the duct 30 to the nozzle 35 opening into the base 14 of the U cross-section central region 13 of the chamber, the air jet fed by the nozzle inducing strong beating and violent undulatory action in the threads, which hence alternately strike the cover 20 and the base 14 of the central region 13. This action, which is limited mainly to the central region of the joint under formation, causes intimate mixing and effective interlacing of the fibres of the two threads to be joined, such as to obtain a very high tensile strength in the central region, this representing the true joint between the threads.

After this first stage of the operation, the duration of which can be suitably adjusted according to the type and nature of the threads or yarns to be joined, compressed air feed to the central nozzle 35 is halted and the second stage is commenced with compressed air feed to the nozzles 36 and 37 which open into the lateral regions 15 and 16 of the chamber. In this manner the ends of the two threads which are already joined in the central region 13 undergo the action of the rotary circulation in respective opposite directions caused by the air jets fed by the nozzles 36 and 37 into the lateral regions 15 and 16, so that these ends are each rolled about the other thread with the result that the mechanical strength of the joint is further increased and the free fibres at the ends of the joint are incorporated, with consequent elimination of projecting fibres and hence an improvement in the appearance of the joint. The action exerted on the end of a thread in either one of the lateral regions of the chamber does not interfere in practice with the action which the end of the other thread undergoes in the other lateral region of the chamber because of the presence between said two lateral regions of a central restriction formed by the central region of U or V cross-section. In this respect, the air jets fed into the two lateral regions of the chamber, which also have the frontal openings of their insertion slits closed by the cover, tend to escape mainly from their lateral mouths without passing into the respective opposite lateral regions.

The duration of said second stage of the operation is also suitably adjustable.

Hence, using the splicing device according to the invention, perfect joints of high mechanical strength and excellent appearance can be achieved with the most varied types of threads and yarns.

I claim:

1. A device using compressed air for the knotless joining of end portions of two threads to thereby produce a spliced thread, comprising:

a head having a front, a rear and two opposite ends;

a longitudinally elongated splicing chamber defined in said head so as to extend along a longitudinal axis between and open through said ends;

said splicing chamber intersecting said front of said head from end to end of said head, and thereby defining a longitudinally elongated slot through which threads to be spliced are transversally introduced into said chamber for splicing, and through which a resulting spliced thread is transversally removed from said chamber; said slot having a given width and being disposed in a plane;

said splicing chamber being constituted by an axially central region and, at axially opposite ends of said central region, two lateral regions, each of which is contiguous at one end thereof with a respective end of said central region and opens at an opposite end thereof through a respective one of said ends of said head;

said chamber in said central region having opposite side walls which are generally parallel to one another and spaced apart by an amount which is generally equal to said given width, having a base wall which is flat, V-shaped or U-shaped in transverse cross-section; and being deeper than wide;

said chamber in said two lateral regions being similarly circularly curved in transverse cross-section throughout an arc which is greater than 180 degrees in angular extent, and being generally as deep as said central region, so that said chamber at its broadest in said two lateral regions is broader than said chamber at its broadest in said central region;

a cover arranged for removably closing said slot from said front of said head;

at least one central nozzle opening into said central region of said chamber through said base wall and aimed towards said slot transversally of said longitudinal axis and perpendicular to said plane of said slot;

two sets of further nozzles, each set having a like number of nozzles, each set having at least one nozzle; each further nozzle in one said set opening into one of said lateral regions of said chamber substantially tangentially thereof along a respective first given angular position about said longitudinal axis; each further nozzle in the other said set opening into the other of said lateral regions of said chamber substantially tangentially thereof at a respective second given angular position about said longitudinal axis; said first and second given angular positions being respectively opposite to one another about an imaginary plane which is perpendicular to said plane of said slot and contains said longitudinal axis;

first compressed air feed ducting effectively connecting with each said central nozzle for controllably intermittently supplying compressed air through each said central nozzle into said central region of said chamber while said slot is frontally closed by said cover, for escape through said ends; and second compressed air feed ducting effectively connecting with each said further nozzle for controllably supplying compressed air through each said further nozzle into respective of said lateral regions of said chamber intermittently during different intervals than when compressed air is being fed from each said central nozzle into said central region, while said slot is frontally closed by said cover, for escape through said ends.

* * * * *